US005493360A

United States Patent [19]

Pummell et al.

[11] Patent Number: 5,493,360

[45] Date of Patent: Feb. 20, 1996

[54] FILM PROCESSOR

[75] Inventors: Leslie J. H. Pummell, Rickmansworth; Paul C. Ward, Watford, both of United Kingdom

[73] Assignee: Eastman Kodak Company, Rochester, N.Y.

[21] Appl. No.: 265,599

[22] Filed: Jun. 24, 1994

Related U.S. Application Data

[63] Continuation-in-part of Ser. No. 90,606, Jul. 12, 1993, abandoned.

[30] Foreign Application Priority Data

Jul. 27, 1992 [GB] United Kingdom ..... 9215957
Jul. 23, 1993 [EP] European Pat. Off. ..... 93305840

[51] Int. Cl.[6] ..... G03D 3/08

[52] U.S. Cl. ..... 354/319; 354/321; 354/322

[58] Field of Search ..... 354/298, 319–324; 226/108, 113, 118, 119

[56] References Cited

U.S. PATENT DOCUMENTS

| | | | |
|---|---|---|---|
| 2,296,048 | 9/1942 | Planskoy | 354/298 |
| 3,462,221 | 8/1969 | Tajima et al. | 355/77 |
| 4,272,185 | 6/1981 | Arai et al. | 354/319 X |
| 4,300,828 | 11/1981 | Kaufmann | 354/322 |
| 4,673,251 | 6/1987 | Sannel | 354/322 |
| 4,881,095 | 11/1989 | Shidara | 354/298 |
| 4,903,100 | 2/1990 | Kogane et al. | 354/321 X |
| 5,223,882 | 6/1993 | Beckmann | 354/319 |

FOREIGN PATENT DOCUMENTS

| | | |
|---|---|---|
| 2706913 | 8/1978 | Germany . |
| 3833733 | 4/1990 | Germany . |
| 90/08981 | 8/1990 | WIPO . |

*Primary Examiner*—D. Rutledge
*Attorney, Agent, or Firm*—Frank Pincelli

[57] ABSTRACT

A photographic film processor comprises six juxtaposed processing tanks, a rack mechanism in each tank operable to circulate the film within processing solution in the respective tank for a certain time. A switch mechanism operable to direct the film from being circulated at the end of that certain time and to direct it to a transfer mechanism by which it is passed to the rack mechanism of the next tank for circulation in that tank. The penultimate tank is a washing tank and there is a transfer mechanism for transferring the film from that washing tank to a dryer which is the last processing station. The film is driven for circulation within and for transfer from one to the next of the six tanks by a first motor which drives a common shaft. A clutch couples or decouples the common shaft to a shorter coaxial shaft by which the film is circulated within the washing tank. Another clutch couples the shorter shaft to another slower motor when it is decoupled from the common shaft by the clutch so that the film can be circulated within the washing tank independently of circulation of film in the other five tanks and is transported out of the washing tank and transferred to the dryer at a speed which is slower than that of which it is circulated on and transferred between the first five tanks.

6 Claims, 2 Drawing Sheets

FILM PROCESSOR

CROSS REFERENCE TO RELATED APPLICATIONS

This is a Continuation-In-Part of application Ser. No. 08/090,606, filed Jul. 12, 1993, now abandoned.

FIELD OF THE INVENTION

This invention relates to a film processor for processing photographic film in elongate strip form.

BACKGROUND OF THE INVENTION

Film processors comprise a plurality of processing stations, a plurality of drive rollers which define a film processing path through the processing stations and drive means for rotating the rollers to transport film along the path, the final processing station being a drying station and the penultimate processing station being a washing station. If the drive rollers of all the processing stations are driven at a constant speed there is no need to couple different transport speeds. Where there is a need to couple film to different transport speeds, it is common practice to use a "slack box", but that introduces complications.

The faster film is withdrawn from water in the washing station, the more water sticks to it. It is better to withdraw film from water in a washing station slowly so that the amount of water it carries is minimised. It is also desirable to transfer the film straight from washing station to drying station because it could start to dry and get sticky if it is left in air between the two.

SUMMARY OF THE INVENTION

An object of this invention is to provide a film processor which can be operated with a balance between the various conflicting requirements discussed above.

According to this invention there is provided a film processor for processing photographic film in elongate strip form, the processor comprising a plurality of processing stations, drive means which are operable to transport the film along a film processing path through the processing stations, the final processing station being a drying station and the penultimate processing station being a washing station, wherein one drive means is provided for transporting the film through each of the processing stations that precedes the washing station and for feeding the film into the washing station at one speed and another, slower drive means independent of said one drive means is provided for withdrawing the film from the washing station at another speed which is slower than said one speed. That obviates the need for an intermediate film store since the film can be left in the washing station without disadvantage.

Preferably the other, slower drive means also is operable to transport film withdrawn from the washing station to the drying station. The other slower drive means may be arranged so that the film is introduced into the drying station at a speed which is fractionally slower than the speed of a transfer web by which it is transported through the drying station. Thus snagging of the film as it is transferred into the drying station is avoided.

A preferred embodiment of this invention includes a plurality of drive rollers which are drivingly rotated by respective drive means to transport the film along the path, wherein one clutch is provided which is operable to rotate the drive rollers of the preceding processing stations, and to drivingly couple drive rollers of the washing station to said one drive means which are operable to rotate the drive rollers of the preceding processing stations, and to decouple the same, and another clutch is provided for drivingly coupling said other drive means to the drive rollers of the washing station when the latter are decoupled from said one drive means.

BRIEF DESCRIPTION OF THE DRAWINGS

One embodiment of this invention will be described now by way of example with reference to the accompanying drawings of which.

DESCRIPTION OF THE PREFERRED EMBODIMENT

Figure 1:
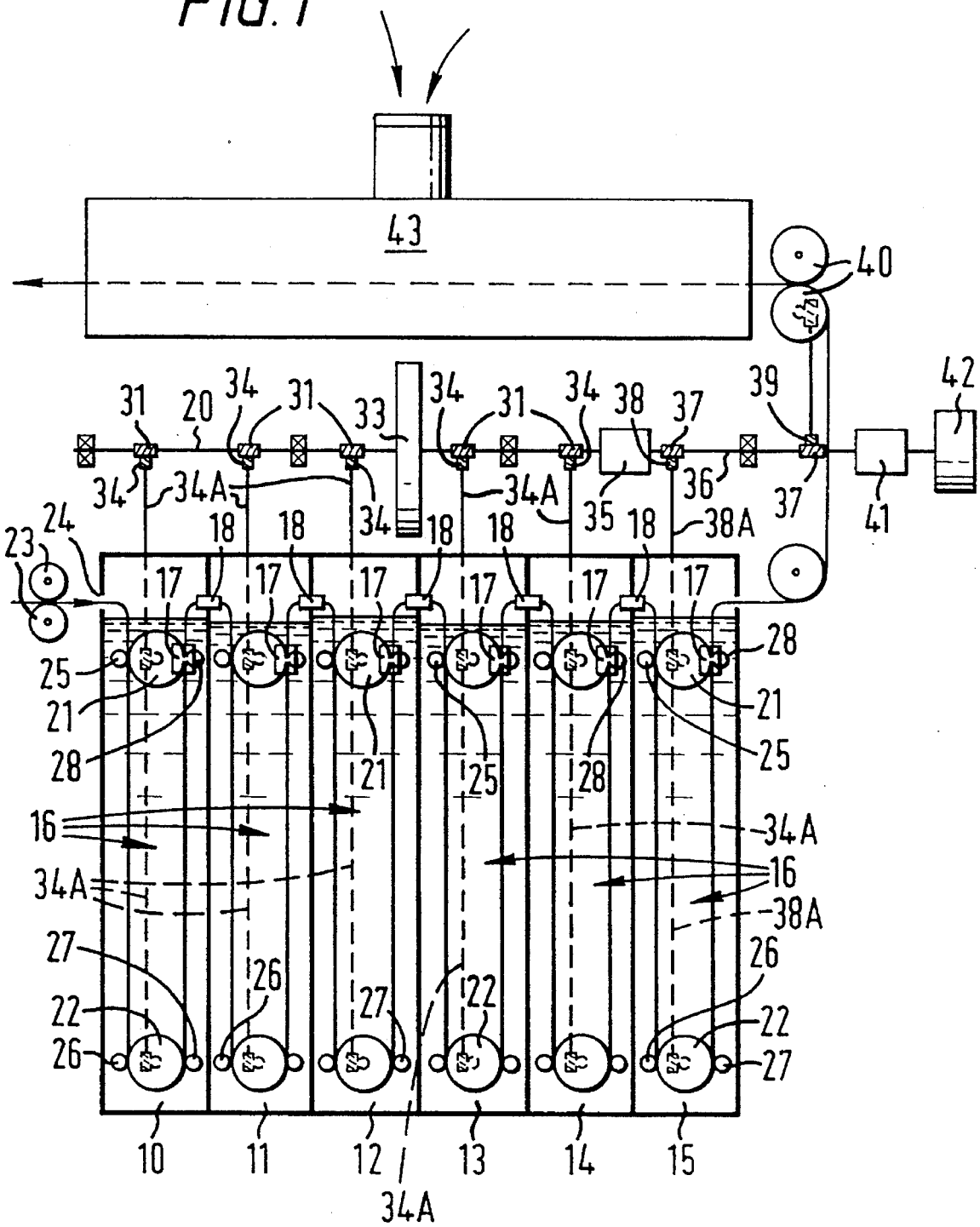
FIG. 1 is a diagram illustrating a film processor in which this invention is embodied.

The film processor illustrated in FIG. 1 is a mini-lab colour film processor machine of the kind described and illustrated in PCT International Patent Publication No. WO90/08981.

The machine has six similar, individually mounted modular tanks 10 to 15, each containing a different processing solution. In each tank 10 to 15, there is a so-called 'rack mechanism', generally indicated at 16, which is operable to circulate a length of film along its length around a closed-loop path immersed in the respective processing solution for a predetermined number of times. The time taken to circulate the film around the closed loop path for the predetermined number of times is substantially the optimum time for the film to be immersed in the developer solution. When the film has been so cycled for the predetermined number of times, a switch mechanism, generally indicated at 17, is actuated to deflect the film out of the closed loop path and to direct it to a film transfer mechanism generally indicated at 18 by which it is fed out of the tank and into the next tank where it is taken up by the rack mechanism 16 of that next tank and circulated around the respective closed loop path in that tank for the predetermined number of times. The rack mechanisms 16 of all the tanks 10 to 15 are driven by a common drive shaft 20 so that the film is moved at a constant speed within and between the tanks 10 to 15. Since the film can be circulated within each tank 10 to 15 for several circuits of the closed loop path, the speed can be fast so that the time taken for transfer through air between juxtaposed tanks 10 to 15 is minimised. It will be understood that the time the film spends immersed in the processing solution in each tank 10 to 15 is not dependent solely upon its speed but also on the number of times it is cycled around the tank and that can be set independently of setting the speed.

Figure 2:
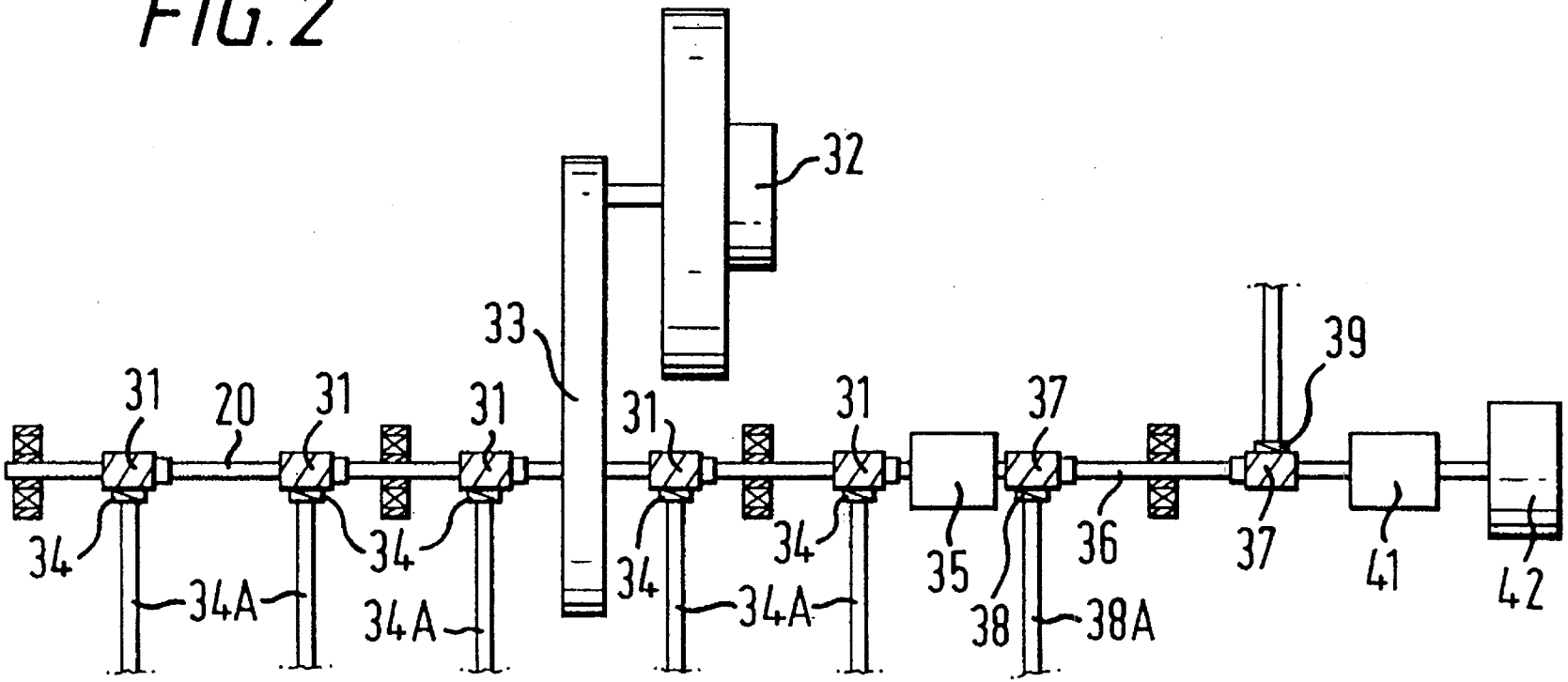
FIG. 2 is a diagram illustrating the drive arrangement of the film processor shown in FIG. 1 in more detail.

The rack mechanism 16 of the first tank which is the developer tank 10 is described in more detail by way of example. It comprises a pair of driven rollers 21 and 22 journalled in support structure so as to rotate one above the other. They are driven by the common drive mechanism of the processor machine, which is illustrated in FIG. 2 arid which includes the common drive shaft 20. Film introduced into the machine for processing is fed by appropriate input feed means 23 through an aperture 24 and directed between the upper driven roller 21 and a co-operating squeegee nip roller 25 by which it is directed towards the lower driven roller 22. The film is passed between a lower squeegee nip roller 26 and the lower roller 22, around the lower roller 22 and between the lower roller 22 and another squeegee nip roller 27. It is then returned to the upper driven roller 21, being fed between that driven roller 21 and yet another squeegee nip roller 28. The switch mechanism 17 is provided near to the last mentioned squeegee nip roller 28. It has two settings. In the first setting it directs the film around the upper driven roller 21 to be fed downwards to the lower driven roller 22 between the cooperating squeegee nip roller 25 and the upper driven roller 21. In the alternative setting to which it is switched when the film has been cycled around the two driven rollers 21 and 22 for a predetermined number of times whilst being totally immersed in the developer solution in the developer tank 10, it deflects the film away from the upper driven roller 21 directly upwards to be fed into the film transfer mechanism 18 by which it is passed out through an outlet aperature of the developer tank 10, through a gate and shield arrangement (not shown) and into the next tank 11, which is a bleach tank, being directed towards the rack mechanism 16 mounted therein.

FIG. 2 shows that the drive shaft 20 has five worms 31 at spaced intervals thereon. A main drive motor 32 drives the drive shaft 20 through a belt drive 33. Each worm 31 meshes with a respective worm wheel 34 by which motion is transmitted from the drive shaft 20 to a respective one of the switch racks 16 of the developer tank 10, the bleach tank (11 and the next three tanks 12 to 14, motion so transmitted by the intermeshed worms 31 and worm wheels 34 to the respective switch racks being synchronised. Motion is transmitted from each worm wheel 34 to the respective switch rack 16 by rotation of a shaft 34A to which the worm wheel 34 is fixed, the shaft 34A being drivingly coupled by suitable gearing with the upper and lower driven rollers 21 and 22 of the respective switch rack 16. The worms 31, the worm wheels 34, the shaft 34A and the gearing are similar so that each switch rack is driven at the same speed. An electromagnetic clutch 35 couples the main drive shaft 20 to a shorter, coaxial shaft 36 which carries two further worms 37. The worm 37 nearer to the electromagnetic clutch 35 meshes with a worm wheel 38 which is drivingly connected to the switch rack 16 of the last tank 15 which is a washing station. The other worm 37 meshes with a worm wheel 39 which is drivingly coupled to transfer drive rollers 40 (see FIG. 1) operable to transport film from the washing tank 15 to an infra-red film dryer 43 in a drying station of the film processor. The dryer 43 forms the subject of the co-pending patent application which designates the priority of British Patent Application No. 9216334.4 filed 31 Jul. 1992. The worms 37 and worm wheels 38 and 39 are respectively of the same size as the worms 31 and worm wheels 34 and the transfer drive rollers 40 are the same size as the rollers 21 and 22 of the switch racks 16 driven by the meshing worms 31, 37 and worm wheels 34,38,39.

Another electromagnetic clutch 41 couples the end of the shorter shaft 36 remote from the electromagnetic clutch 35 to another drive motor 42.

In operation of the film transport arrangement illustrated in the drawings, the motor 32 drives the main drive shaft 20 to transport a length of film through the five processing stations provided by the five tanks 10 to 14 with which the five worm wheels 34 are associated. The clutches 35 and 41 are de-energised so that the shorter shaft 36 is disconnected from both the main drive shaft 20 and the motor 42 whilst the film is being transported through those tanks 10 to 14, but the web transport of the infra-red dryer 43 is driven to prevent it overheating.

As the film nears the end of its process time in the tank 14 which immediately precedes the washing tank 15, the clutch 35 is energised so that the shorter shaft 36 is coupled to the main drive shaft 20. As a result the film is transferred into the washing tank 15 from the tank 14 at the speed at which it has been drawn through all the preceding tanks 10 to 14. It is also circulated within water in the washing station by drive transmitted from the main drive shaft 20 through the clutch 35 to the shorter shaft 36 and through the intermeshing worm 37 and worm wheel 38 and the shaft 38A on which the worm wheel 38 is fixed, to the respective switch rack mechanism 16.

When the predetermined process time for the film in the washing tank 15 has elapsed, the electromagnetic clutch 35 is de-energised so that the shorter shaft 36 is decoupled from the main drive shaft 20 and the film comes to a stop in the washing tank 15. The other clutch 41 is then energised to couple the other motor 42 to the shorter shaft 36. The other motor 42 is arranged to drive the shaft 36 at a slower speed than the speed by which it was driven when coupled to the main drive shaft 20. Hence the film is withdrawn from the washing tank 15 by the transfer drive rollers 40 that are driven by the intermeshing worm 37 and worm wheel 39 at the desirable slower speed which results in the squeegeeing action on the film being better than it would be if it had been withdrawn at the higher speed at which the shaft 36 is driven by the main drive shaft 20, and with the result that it has less water sticking to it. The other motor 42 also drives the transport rollers 40 so that they feed the film onto the transport web of the infra-red film dryer 43 at a speed which is fractionally slower than the speed of the transport web, thus avoiding the film snagging the rest of the transport web.

When all the film has been transferred from the washing tank 15 to the transport web of the infra-red film dryer 43, the other motor 42 is switched off and the other clutch 41 is de-energized to decouple the shorter shaft 36 from the other motor 42. Thus the apparatus is ready for processing another length of film.

It will be understood that the film processor incorporates control means by which the sequential operation of the clutches 35 and 41 and the motor 42 as described above is controlled automatically.

We claim:

1. A film processor for processing photographic film in elongate strip form, the processor comprising a plurality of processing stations (10 to 15 and 43), drive means (32 and 42) which are operable to transport the film along a film processing path through the processing stations (10 to 15 and 43), the final processing station (43) being a drying station and the penultimate processing station (15) being a washing station, characterised in that one drive means (32) is provided for transporting the film through each of the processing stations (10 to 14) that precedes the washing station (15) and for feeding the film into the washing station (15) at one speed and another, slower drive means (42) independent of said one drive means (32) is provided for withdrawing the film from the washing station (15) at another speed which is slower than said one speed.

2. A film processor according to claim 1, wherein the other, slower drive means (42) also is operable to transport film withdrawn from the washing station (15) to the drying station (43).

3. A film processor according to claim 2, wherein the other, slower drive means (42) is arranged so that the film is introduced into the drying station (43) at a speed which is fractionally slower than the speed of a transfer web by which it is transported through the drying station (43).

4. A film processor according to claim 1, including a plurality of drive rollers (21,22,40) which are drivingly rotated by respective drive means (32,42) to transport the film along the path, wherein one clutch (35) is provided which is operable to drivingly couple drive rollers (21 and 22) of the washing station (15) to said one drive means (32) which are operable to rotate the drive rollers (21 and 22) of the preceding processing stations (10 to 14), and to decouple the same, and another clutch (41) is provided for drivingly coupling said other drive means (42) to the drive rollers (21 and 22) of the washing station (15) when the latter are decoupled from said one drive means (32).

5. A film processor according to claim 2, including a plurality of drive rollers (21,22,40) which are drivingly rotated by respective drive means (32,42) to transport the film along the path, wherein one clutch (35) is provided which is operable to drivingly couple drive rollers (21 and 22) of the washing station (15) to said one drive means (32) which are operable to rotate the drive rollers (21 and 22) of the preceding processing stations (10 to 14), and to decouple the same, and another clutch (41) is provided for drivingly coupling said other drive means (42) to the drive rollers (21 and 22) of the washing station (15) when the latter are decoupled from said one drive means (32).

6. A film processor according to claim 3, including a plurality of drive rollers (21,22,40) which are drivingly rotated by respective drive means (32,42) to transport the film along the path, wherein one clutch (35) is provided which is operable to drivingly couple drive rollers (21 and 22) of the washing station (15) to said one drive means (32) which are operable to rotate the drive rollers(21 and 22) of the preceding processing stations (10 to 14), and to decouple the same, and another clutch (41) is provided for drivingly coupling said other drive means (42) to the drive rollers (21 and 22) of the washing station (15) when the latter are decoupled from said one drive means (32).

* * * * *